US009235189B2

(12) United States Patent
Saito

(10) Patent No.: US 9,235,189 B2
(45) Date of Patent: Jan. 12, 2016

(54) IMAGE FORMING APPARATUS

(71) Applicant: Brother Kogyo Kabushiki Kaisha, Nagoya-shi, Aichi-ken (JP)

(72) Inventor: Toshiya Saito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/553,116

(22) Filed: Nov. 25, 2014

(65) Prior Publication Data

US 2015/0147086 A1 May 28, 2015

(30) Foreign Application Priority Data

Nov. 28, 2013 (JP) ..... 2013-245658

(51) Int. Cl.
*G03G 15/00* (2006.01)
*G03G 21/16* (2006.01)

(52) U.S. Cl.
CPC ..... *G03G 21/1633* (2013.01); *G03G 21/1619* (2013.01); *G03G 2215/0132* (2013.01)

(58) Field of Classification Search
CPC ..... G03G 21/1619; G03G 21/1633; G03G 21/1647; G03G 21/1678
USPC ..... 399/107
See application file for complete search history.

(56) References Cited

U.S. PATENT DOCUMENTS 7,484,722 B2 2/2009 Ishii
7,748,706 B2 7/2010 Ishii
7,995,948 B2 8/2011 Yano et al.
8,155,556 B2 4/2012 Moribe et al.
8,204,401 B2 6/2012 Tsuchiya
2006/0008294 A1 1/2006 Ito et al.
2006/0269320 A1 11/2006 Ishii
2007/0002290 A1 1/2007 Muraki et al.
2007/0036604 A1 2/2007 Maekawa et al.
2008/0049260 A1 2/2008 Moribe et al.

(Continued)

FOREIGN PATENT DOCUMENTS

JP H03-217861 A 9/1991
JP 2002-137493 A 5/2002

(Continued)

OTHER PUBLICATIONS

May 22, 2015—(US) Notice of Allowance—U.S. Appl. No. 14/547,608.

(Continued)

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus, including an image forming unit, a body accommodating the image forming unit, and a cover configured to form a part of an exterior covering of the body, is provided. The cover includes a first rib formed to protrude from an inner surface of the cover and extend longitudinally along the inner surface of the cover. The first rib extends to incline with respect to a horizontal plane to be higher at one end on a first side of the image forming apparatus and lower at the other end on a second side of the image forming apparatus. An upper surface of the first rib extends continuously from the one end to the other end and is discontinued at the other end, the other end of the upper surface of the first rib being separated from the exterior covering.

12 Claims, 11 Drawing Sheets

(56) References Cited

U.S. PATENT DOCUMENTS

| | | | |
|---|---|---|---|
| 2009/0116889 | A1 | 5/2009 | Ishii |
| 2013/0272744 | A1 | 10/2013 | Wakayama et al. |

FOREIGN PATENT DOCUMENTS

| | | | |
|---|---|---|---|
| JP | 2002-182441 | A | 6/2002 |
| JP | 2002-351282 | A | 12/2002 |
| JP | 2005-018011 | A | 1/2005 |
| JP | 2006-053508 | A | 2/2006 |
| JP | 2006-337570 | A | 12/2006 |
| JP | 2007-062159 | A | 3/2007 |
| JP | 2007-292968 | A | 11/2007 |
| JP | 2008-052037 | A | 3/2008 |
| JP | 2009-169120 | A | 7/2009 |
| JP | 2009-169126 | A | 7/2009 |
| JP | 4826387 | B2 | 11/2011 |
| JP | 2012-203989 | A | 10/2012 |

OTHER PUBLICATIONS

Jun. 11, 2015—(US) Notice of Allowance—U.S. Appl. No. 14/525,608.

Apr. 10, 2015—(US) Non-Final Office Action—U.S. Appl. No. 14/538,304.

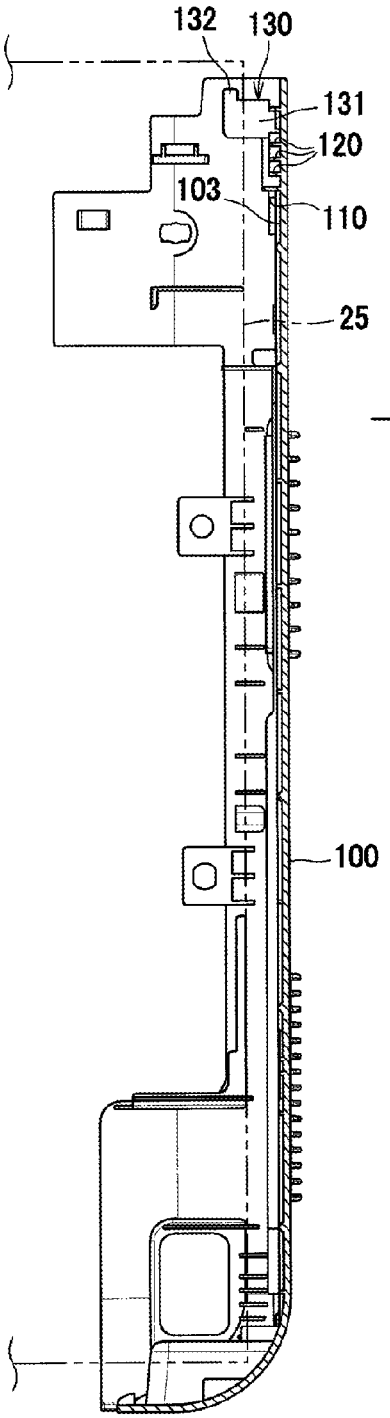
FIG. 3A
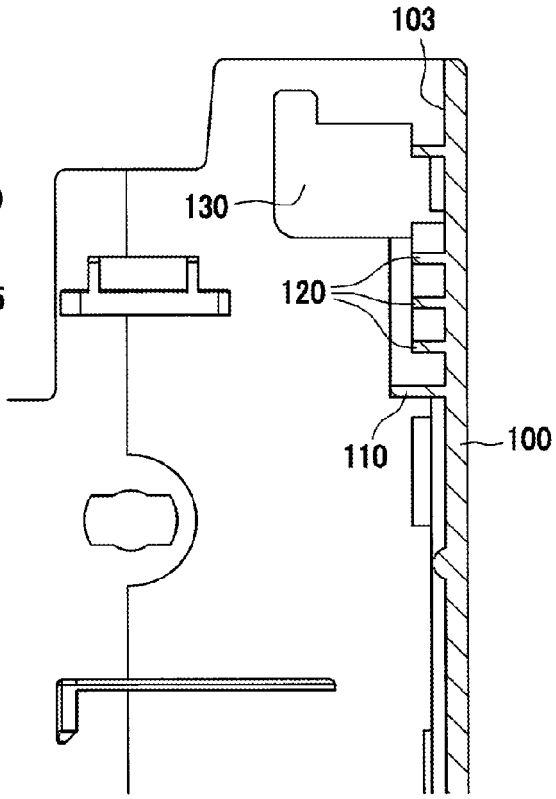
FIG. 3B
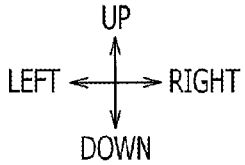

IMAGE FORMING APPARATUS

CROSS REFERENCE TO RELATED APPLICATION

This application claims priority from Japanese Patent Application No. 2013-245658 filed on Nov. 28, 2013, the entire subject matter of which is incorporated herein by reference.

BACKGROUND

1. Technical Field

An aspect of the present invention relates to an image forming apparatus having a cover, which covers laterals of a body of the image forming apparatus to form exterior faces of the body.

2. Related Art

A conventionally known image forming apparatus may include a plurality of covering parts that form exterior faces of a main body of the image forming apparatus. In such an image forming apparatus, processing devices such as a photosensitive unit, a developer device, a fixing device, a motor, and circuit boards may be disposed inside the covering parts.

SUMMARY

While the exterior faces are formed with the plurality of covering parts, there are boundaries between adjoining covering parts. With the boundaries of the covering parts on the exterior faces of the image forming apparatus, if the body of the image forming apparatus is exposed to liquid such as water, the liquid may enter inside the body through the boundaries.

The present invention is advantageous in that an image forming apparatus, in which the processing devices contained therein may be prevented from being reached by the liquid when the liquid enters inside through the boundaries, is provided.

According to an aspect of the present invention, an image forming apparatus, including an image forming unit, a body accommodating the image forming unit, and a cover configured to form a part of an exterior covering of the body, is provided. The cover includes a first rib formed to protrude from an inner surface of the cover and extend longitudinally along the inner surface of the cover. The first rib extends to incline with respect to a horizontal plane to be higher at one end on a first side of the image forming apparatus and lower at the other end on a second side of the image forming apparatus. An upper surface of the first rib extends continuously from the one end to the other end and is discontinued at the other end, the other end of the upper surface of the first rib being separated from the exterior covering.

BRIEF DESCRIPTION OF THE ACCOMPANYING DRAWINGS

FIG. 3A is a horizontal cross-sectional view of a side cover of the MFD according to the embodiment of the present invention. FIG. 3B is an enlarged partial view of an area including a first rib and a second rib in the MFD according to the embodiment of the present invention.

DETAILED DESCRIPTION

Hereinafter, a configuration of an MFD 1 according to an embodiment of the present invention will be described with reference to the accompanying drawings.

The MFD 1 is a multifunction peripheral device capable of processing a plurality of types of operations, which include, for example, an image forming operation and an image reading operation. The MFD 1 includes a main body 2, an image reader 3, and an operation panel unit 4 which are arranged in upper positions with respect to the main body 2.

Figure 2:
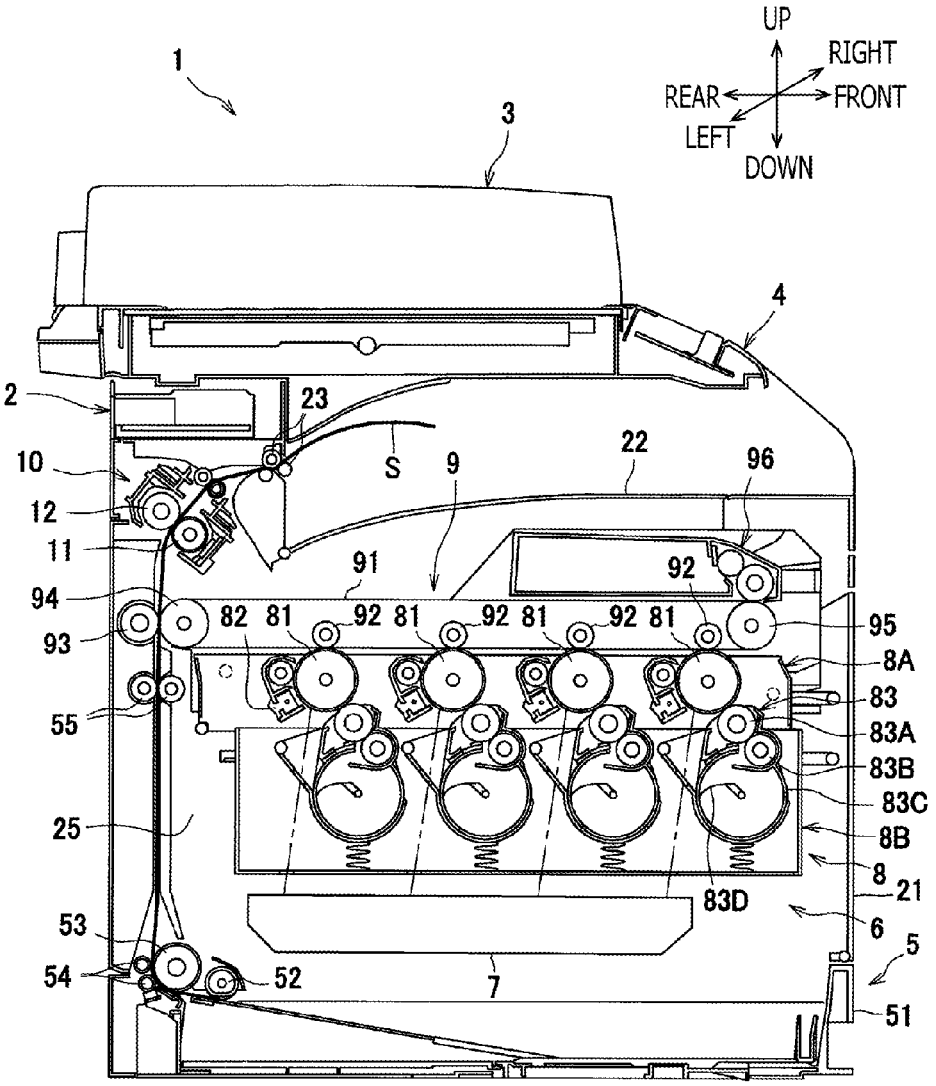
FIG. 2 is an overall cross-sectional view of the MFD according to the embodiment of the present invention.

The MFD 1 further includes, as shown in FIG. 2, a feeder unit 5 to feed a sheet S to the main body 2 and an image forming section 6 to form an image on the sheet S fed by the feeder unit 5.

In the following description, directions concerning the MFD 1 and parts included in the MFD 1 will be based on a user's ordinary usable posture to use the MFD 1 and referred to in accordance with orientation indicated by arrows in each drawing. Therefore, for example, a right-hand side and a left-hand side on FIG. 2 are defined as a front side and a rear side respectively. A nearer side and a farther side in FIG. 2 are defined as left and right respectively. A right-to-left or left-to-right direction of the MFD 1 may also be referred to as a right-left direction or a widthwise direction. An up-to-down or down-to-up direction corresponds to a vertical direction of the MFD 1. The front-to-rear or rear-to-front direction may be referred to as a front-rear direction or a direction of depth. Furthermore, directions of the drawings in FIGS. 1, 3-11 are similarly based on the orientation of the MFD 1 as defined above and correspond to those with respect to the MFD 1 shown in FIG. 2 even when the MFD 1 in the drawings is viewed from different angles.

The image reader 3 is a flatbed scanner in a known configuration, which irradiates light upon an original sheet and reads an image appearing on the original sheet to generate image data and duplicate the image. The operation panel unit 4 is arranged in a frontward adjoining position with respect to the image reader 3. The operation panel unit 4 includes a display device to display information and a plurality of buttons, which are handled by a user so that the user can manipulate the MFD 1 through the buttons. The operation panel unit 4 is rotatable about an upper-rearward edge thereof with respect to the main body 2.

The main body 2 includes a pair of side frames 25, which are arranged on each widthwise side of the image forming section 6 (in FIG. 2, solely one on the right is shown). The side frames 25 support units and components that form the image forming section 6. Furthermore, a motor (not shown) to provide driving force to the image forming section 6 and a circuit board (not shown) to supply electricity to the image forming section 6 are disposed on outer sides of the side frames 25.

The feeder unit 5 is arranged in a lower position in the main body 2 and includes a sheet cassette 51, which is detachably attached to the main body 2, a pickup roller 52 arranged in an upper-rearward position with respect to the sheet cassette 51, a separator roller 53, and feed rollers 54, 55. The sheets S in the sheet cassette are picked up by the pickup roller 52, separated one-by-one by the separator roller 53, conveyed upward by the feed rollers 55, 55, and fed to the image forming section 6, in particular, to a position between an intermediate transfer belt 91 and a secondary transfer roller 93.

The image forming section 6 includes an exposure unit 7, a processing unit 8, a belt unit 9, and a fixing unit 10.

The exposure unit 7 is arranged in an upper position with respect to the feeder unit 5 and includes known laser emitters, polygon mirrors, a plurality of lenses and reflection mirrors, which are not shown. In the exposure unit 7, laser beams corresponding to colors of yellow, cyan, magenta, and black respectively emitted from the laser emitters and reflected on the polygon mirrors and the reflection mirrors transmit through the lenses and are irradiated onto surfaces of photosensitive drums 81 in the processing unit 8.

The processing unit 8 includes a photosensitive unit 8A and a developer unit 8B. The photosensitive unit 8A and the developer unit 8B are detachably attached to the main body 2 through an opening (not shown), which is exposed when a front cover 21 on the front side of the main body 2 is open.

The photosensitive unit 8A is arranged in an upper position with respect to the exposure unit 7, in a position between the developer unit 8 and the belt unit 9. The photosensitive unit 8A includes four (4) photosensitive drums 81, which are arranged to align along the front-rear direction, and chargers 82, each of which is arranged in a corresponding position with respect to one of the photosensitive drums 81.

The developer unit 8B is arranged in a position between the exposure unit 7 and the photosensitive unit 8A and includes four (4) developer devices 83, each of which is arranged in a corresponding position with respect to one of the photosensitive drums 81.

Each developer device 83 includes a developer roller 83A, a supplier roller 83B, a toner container 83C, and an agitator 83D. The developer roller 83A is arranged to face the corresponding photosensitive drum 81, and the supplier roller 83B supplies toner to the developer roller 83A. The toner container 83C contains the toner to be supplied to the developer roller 83A, and the agitator 83D is disposed in the toner container 83C. In the developer device 83, the toner in the toner container 83C is supplied to the supplier roller 83B by the agitator 83D being rotated and supplied from the supplier roller 83B to the developer roller 83A to be carried on a surface of the developer roller 83A.

The belt unit 9 is arranged in an upper position with respect to the photosensitive unit 8A and includes an intermediate transfer belt 91, four (4) primary transfer rollers 92, a secondary transfer roller 93, a driving roller 94, a driven roller 95, and a cleaner unit 96.

The intermediate transfer belt 91 is an endless belt strained around the driving roller 94 and the driven roller 95, which are arranged in parallel with each other to be separated from each other along the front-rear direction. The photosensitive drums 81 are arranged to face and contact a lower-outer surface of the intermediate transfer belt 91, and the second transfer roller 93 is arranged to face and contact an outer-rear surface of the intermediate transfer belt 91.

Each primary transfer roller 92 is arranged to contact an inner surface of the intermediate transfer belt 91 in an opposite position from one of the photosensitive drums 81 across the intermediate transfer belt 91 to nip the intermediate transfer belt 91 between the primary transfer roller 92 and the photosensitive drum 81. The secondary transfer roller 93 is arranged to face the driving roller 94 across the intermediate transfer belt 91 to nip the intermediate transfer belt 91 between the secondary transfer roller 6 and the driving roller 94. A predetermined level of transfer bias is applied to the primary transfer rollers 92 and the secondary transfer roller 93 when an image is transferred onto the primary transfer rollers 92 and the secondary transfer roller 93.

The cleaner unit 96 is arranged in an upper-frontward position with respect to the intermediate transfer belt 91. The cleaner unit 96 removes the residual toner from the intermediate transfer belt 91 and store the removed toner therein.

The fixing unit 10 is arranged in an upper position with respect to the secondary transfer roller 93 and the driving roller 94. The fixing unit 410 includes a known heat roller 11 and a known pressure roller 12, which is arranged to face the heat roller 11 to apply pressure to the heat roller 11.

The image forming section 6 configured as above forms an image on the sheet S in the following procedure: The surfaces of the photosensitive drums 81 are evenly charged by the chargers 82 and exposed to the laser beams emitted from the exposure unit 7. Thereby, electric potential in the areas exposed to the laser beams is lowered, and latent images corresponding to the images to be formed on the sheet S are formed on the surfaces of the photosensitive drums 81.

Thereafter, when the developer roller 83A and the photosensitive drum 81 contact each other, the toner carried on the developer roller 83A is supplied to the latent image formed on the photosensitive drum 81. Thereby, the toner is selectively carried on the photosensitive drum 81 so that the latent image is developed to be a toner image.

The toner images thus formed on the photosensitive drums 81 are transferred onto the intermediate transfer belt 91 sequentially by an effect of the transfer bias applied to the primary transfer rollers 92. The toner images in the four colors transferred onto the intermediate transfer belt 91 are further transferred onto the sheet S when the sheet S fed to the image forming section 6 passes through the nipped position between the intermediate transfer belt 91 and the secondary transfer roller 93 by an effect of the transfer bias applied to the secondary transfer roller 93.

The sheet S with the toner images transferred thereon is conveyed to the fixing unit 10 and passes through the nipped position between the heat roller 11 and the pressure roller 12 so that the toner images are thermally fixed thereon. The sheet S with the thermally-fixed toner images is conveyed by an ejection roller 23 through an upper part of the main body 2 to be ejected out of the main body 2.

Figure 1:
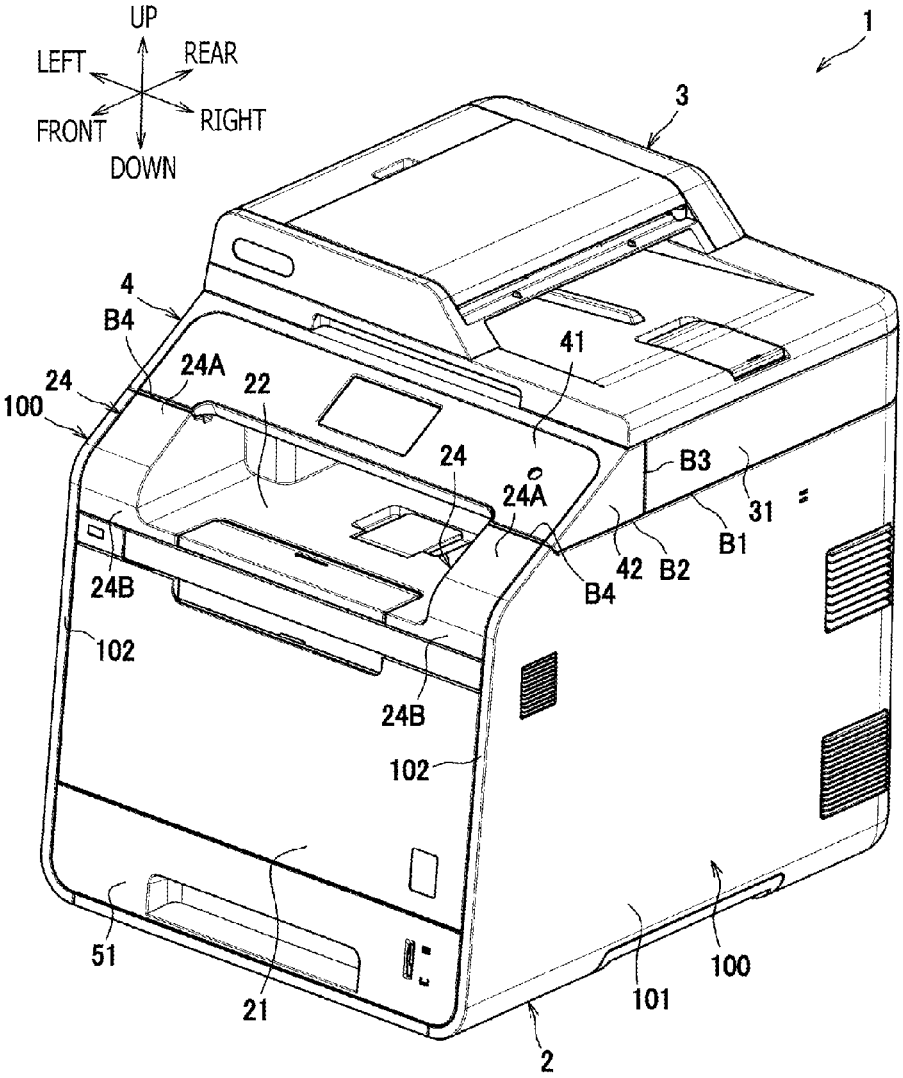
FIG. 1 is a perspective external view of an MFD (multifunction peripheral device) according to an embodiment of the present invention.

As shown in FIG. 1, the main body 2 is formed to have an ejection tray 22, on which the sheet S ejected by the ejection roller 23 is placed, in the upper part thereof. Meanwhile, on widthwise ends of the ejection tray 22, a pair of vertical blocks 24 protruding upward from the ejection tray 22 are formed.

Further, the main body 2 includes a pair of side covers 100, which are arranged to cover widthwise sides of the main body 2, more specifically, laterals of the side frames 25 and the vertical blocks 24, to form an exterior covering of the main body 2.

Each of the vertical blocks 24 includes an inclined plane 24A, which faces upper-frontward, and an upright plane 24B, which stretches downward from a lower end of the inclined plane 24A.

Each of the side covers 100 includes a main part 101, which forms a widthwise face of the main body 2, and a front part 102, which faces frontward at a front side of the main part 101.

The front part 102 adjoins the vertical block 24 at an upper portion thereof and adjoins the front cover 21 and the sheet cassette 51, which form the front face of the main body 2, at a lower portion thereof. A surface of the front part 102 aligns with the inclined plane 24A of the vertical block 24 on a same plane and with the upright plane 24B of the vertical block 24 on a same plane respectively, and with the front face of the front cover 21 and the front face of the sheet cassette 51 on a same plane at the lower portion.

The operation panel unit 4 spreads along the widthwise direction at an upper position with respect to the ejection tray 22, and widthwise end portions thereof are arranged on the vertical blocks 24. An outer surface 41 forming an exterior surface of the operation panel unit 4 faces upper-frontward and adjoins the inclined plane 24A of the vertical block 24 and the upper portions of the front parts 102 of the side covers 100 to align on a same plane. The operation panel unit 4 further includes a pair of second lateral faces 42 (solely one on the right is shown in FIG. 1), each of which forms a part of the exterior covering of the operation panel unit 4 at a widthwise end. Each second lateral face 42 is arranged on the side cover 100 and adjoins the main part 101 of the side cover 100 to align on a same plane.

Meanwhile, the image reader 3 includes a pair of first lateral faces 31, each of which forms a part of an exterior covering of the image reader 3 at a widthwise end. Each first lateral face 31 is arranged on the side cover 100 and adjoins the main part 101 of the side cover 100 and the second lateral face 42 of the operation panel unit 4 to align on a same plane.

Figure 4:
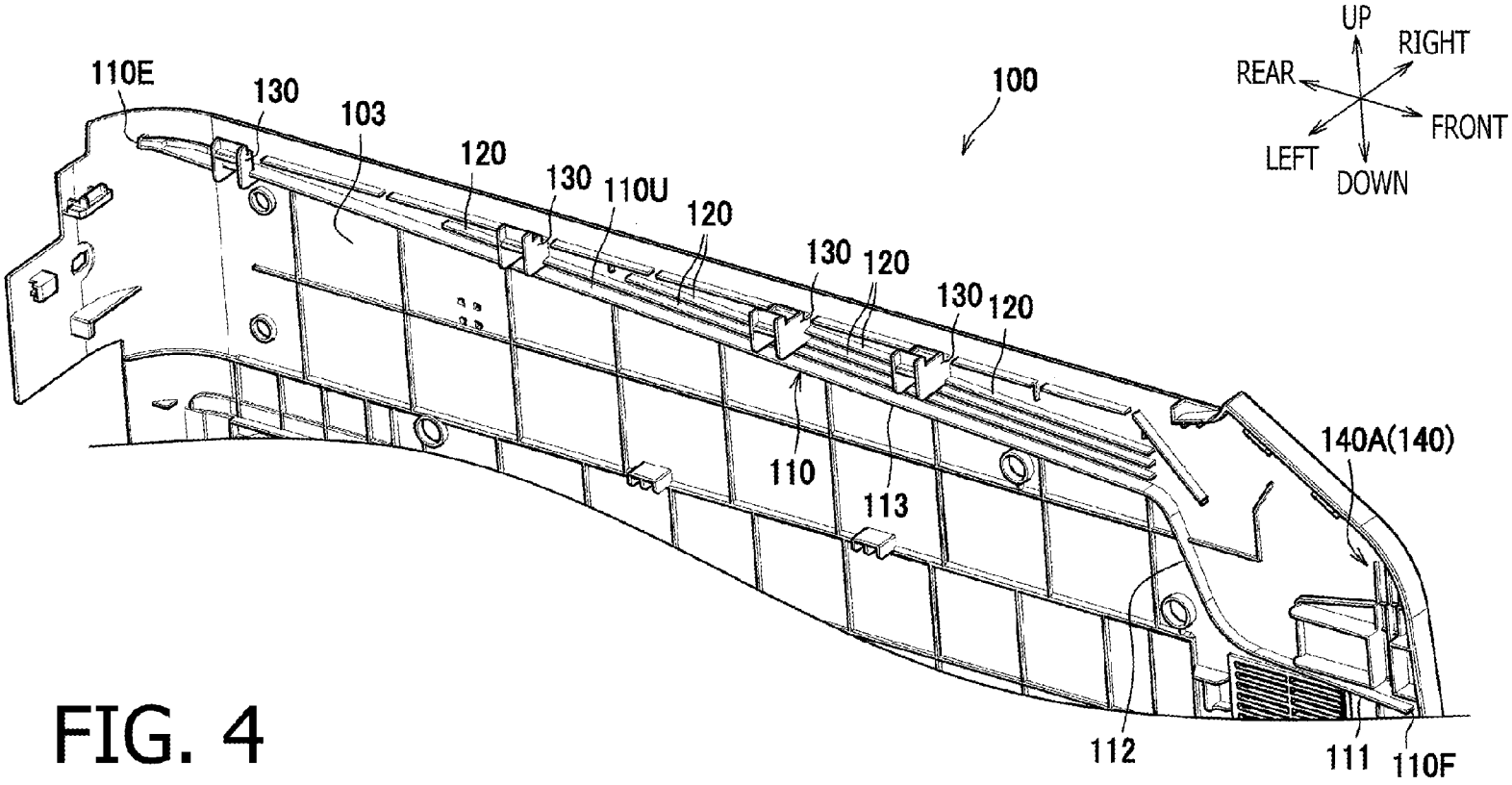
FIG. 4 is a perspective view showing an upper edge on an inner side of the side cover in the MFD according to the embodiment of the present invention.

As shown in FIGS. 3A and 4, each side cover 100 (solely one on the right is shown) is formed to have a first rib 110, a plurality of second ribs 120, and a plurality of hooks 130 in an upper portion thereof. The first rib 110 is formed to protrude inwardly from an inner surface 103 of the side cover 100. The second ribs 120 are formed in upper positions with respect to the first rib 110 to protrude inwardly from the inner surface 103 of the side cover 100. The hooks 130 are formed to protrude further inwardly than the first rib 110 and the second ribs 120. The side cover 100 further includes an on-cover channel 140A at a front end on the inner surface 103 thereof. The on-cover channel 140A forms a part of a channel 140 formed on the side cover 100, in which liquid entering through a periphery of the operation panel unit 4 may be drained.

The plurality of hooks 130 are arranged to be spaced apart from one another along the front-rear direction. Each hook 130 includes, as shown in FIG. 3A, an extended portion 131, which extends from the inner surface 103 of the side cover 100 inwardly along the widthwise direction, and an engageable portion 132, which extends upwardly from an inner end of the extended portion 131. When the hooks 130 are engaged with the side frame 25, which is arranged on the inner side position of the side cover 100, the side cover 100 is fixed to the side frame 25.

As shown in FIG. 4, the first rib 110 extends along the inner surface 103 of the side cover 100 longitudinally in the front-rear direction. A front end 110F of the first rib 110 is formed at the front end of the side cover 100, and a rear end 110E of the first rib 100 is formed at a rear end portion of the side cover 100.

Figure 6:
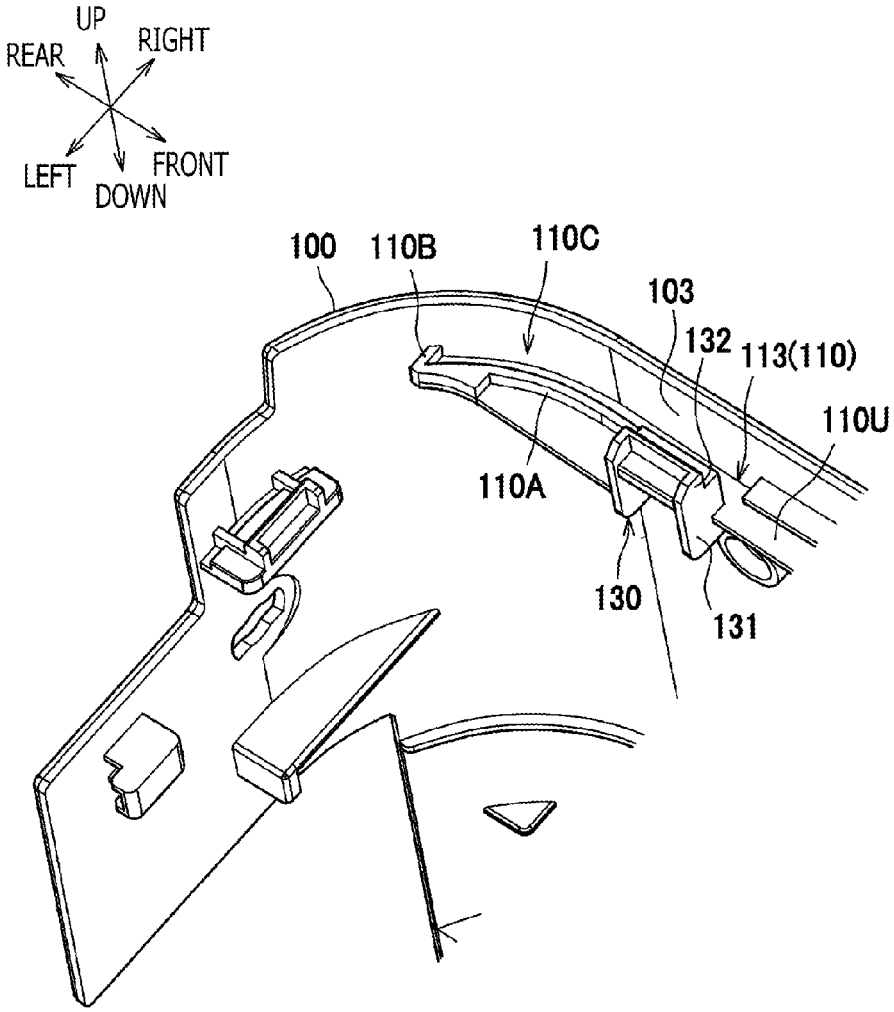
FIG. 6 is a perspective view of a rear-end portion of the first rib in the MFD according to the embodiment of the present invention.

The first rib 110 is formed to extend rearward beyond a rearmost one of the hooks 130 through a position between the engageable portion 132 of the rearmost hook 130 and the inner surface 103 of the side cover 100 (see FIG. 6). In other words, an upper surface 110U of the first rib 110 extends continuously between the front and the rear of the rearmost hook 130. On the other hand, on a front side of the rearmost hook 130, the first rib 110 extends in lower positions with respect to the remainder of the hooks 130 other than the rearmost hook 130 (see FIG. 4). The upper surface 110U of the first rib 110 extends continuously between the rear end 110E and the front end 110F.

Figure 5:
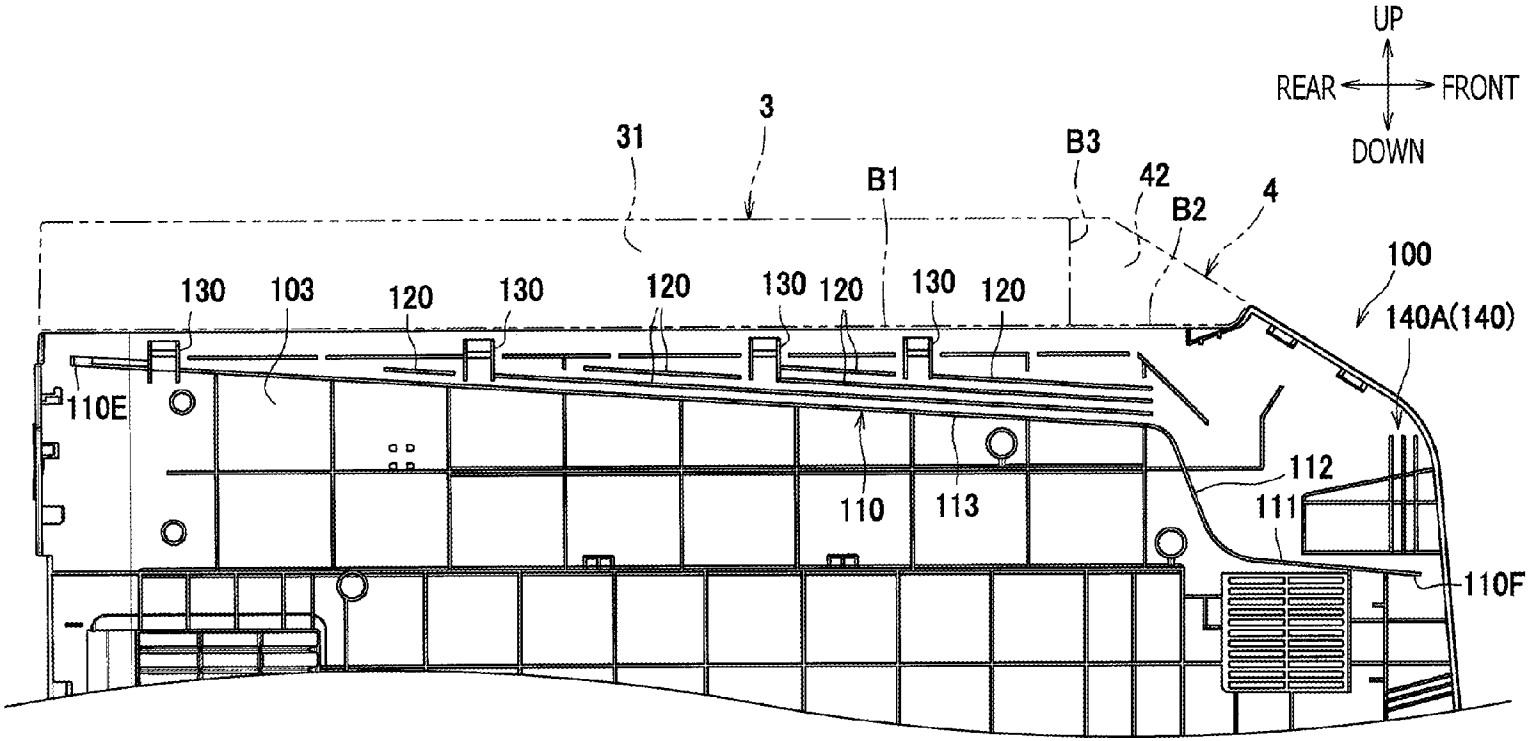
FIG. 5 is a side view showing the upper edge on the inner side of the side cover in the MFD according to the embodiment of the present invention.

Thus, as shown in FIG. 5, the first rib 110 as a whole inclines downward toward the front with respect to a horizontal plane to be higher at the rear end 110E and lower at the front end 110F. The first rib 110 is cut off at the front end 110F thereof without being connected to an inner surface of the front part 102 of the side cover 100 so that the upper surface 110U of the first rib 110 is discontinued at the front end 110F. In other words, the front end 110F of the first rib 110 is separated from the inner surface of the front part 102 of the side cover 100 so that a gap is reserved between the front end 110F and the inner surface of the front part 102 of the side cover 100. Thus, the liquid flowing on the upper surface 110U of the first rib 110 may fall down from the front end 110F of the first rib 110 or may be tossed from the front end 110F along the extending direction of the first rib 110.

The first rib 110 includes a first part 111, a second part 112, and a third part 113. The first part 111 is arranged at a frontward position in the side cover 100. The second part 112 extends in upper-rearward inclination from a rear end of the first part 111. The third part 113 extends from a rear end of the second part 112 in more moderate inclination than the inclination of the second part 112. Intervening curved parts between the first part 111 and the second part 112 and between the second part 112 and the third part 113 are formed in curvature.

In the present embodiment, the first part 111 and the third part 113 extend substantially in parallel with each other. An angle of the inclination of the third part 113 with respect to a horizontal plane may preferably be at least 3.0 degrees or larger, e.g., 3.5 degrees, so that the liquid on the third part 113 should flow frontward along the third part 113.

A front end of the third part 113 is placed in a lower position with respect to the operation panel unit 4. In other words, the third part 113 is placed below a boundary B3, where the first lateral face 31 and the second lateral face 42 adjoins each other. The components such as the motor and the circuit board, which are not shown but are arranged on the outer surface of the side frame 25, are disposed in lower positions with respect to the third part 113. Meanwhile, the first part 111 is placed in a lower position with respect to a boundary B4 between a front end of the operation panel unit 4 and the vertical block 24.

As shown in FIG. 6, the third part 113 includes a first upright curb 110A and a second upright curb 110B. The first upright curb 110A is formed at a rear end of the third part 113 to rise upward from the upper surface 110U of the third part 113 to face with the inner surface 103 of the side cover 100. The second upright curb 110B is formed at a rear edge of the third part 113 to rise upward to connect a rear end of the first upright curb 110A with the inner surface 103 of the side cover 100.

With the first and second upright curbs 110A, 110B, an area surrounded by the upper surface 110U of the third part 113, the first upright curb 110A, the second upright curb 110B, and the inner surface 103 of the side cover 103 forms a groove 110C.

As shown in FIG. 5, the plurality of second ribs 120 are arranged to align with the third part 113 of the first rib 110 and extend along the third part 113 to incline linearly to be higher at the rear and lower at the front. The second ribs 120 are arranged to adjoin one another along the vertical direction and align with one another along the front-rear direction.

That is, some of the second ribs 120 align along the front-rear direction with one of the hooks 130 interposed in therebetween. In this regard, a front end of one of the aligning second ribs 120 on a rear side with respect to the interposing hook 130 is separated from the interposing hook 130. On the other hand, a rear end of the other of the aligning second ribs 120 on a front side with respect to the interposing hook 130 is connected with the interposing hook 130 so that intensity of the side cover 100 may be enhanced.

Meanwhile, some of the second ribs 120 adjoin each other along the vertical direction. An amount of a gap between the vertically adjoining second ribs 120, or an amount of a gap between a lowermost one of the second ribs 120 and the adjoining first rib 110, may preferably be at least 2.0 mm or larger, or may be, for example, 3.0 mm, so that, when the liquid on the second ribs 120 falls from the second ribs 120 rather than flowing frontward along the inclination on upper surfaces of the second ribs 120, the liquid should spread in the gaps among the plurality of second ribs 120 and fall moderately on the first rib 110.

As shown in FIG. 3B, the plurality of second ribs 120 are formed to protrude inward from the inner surface 103 of the side cover 100 for a same protruding amount. Meanwhile, a protruding amount for the first rib 110 to protrude from the inner surface 103 of the side cover 100 is greater than the protruding amount of the second ribs 120.

The protruding amount for the first rib 110 may be larger than 2.0 mm, preferably larger than 2.5 mm, and may be, for example, 5.0 mm so that the first rib 110 should catch the liquid falling down from above. The protruding amount for the second ribs 120 may preferably be larger than 2.0 mm, and may be, for example, 3.0 mm.

Figure 7:
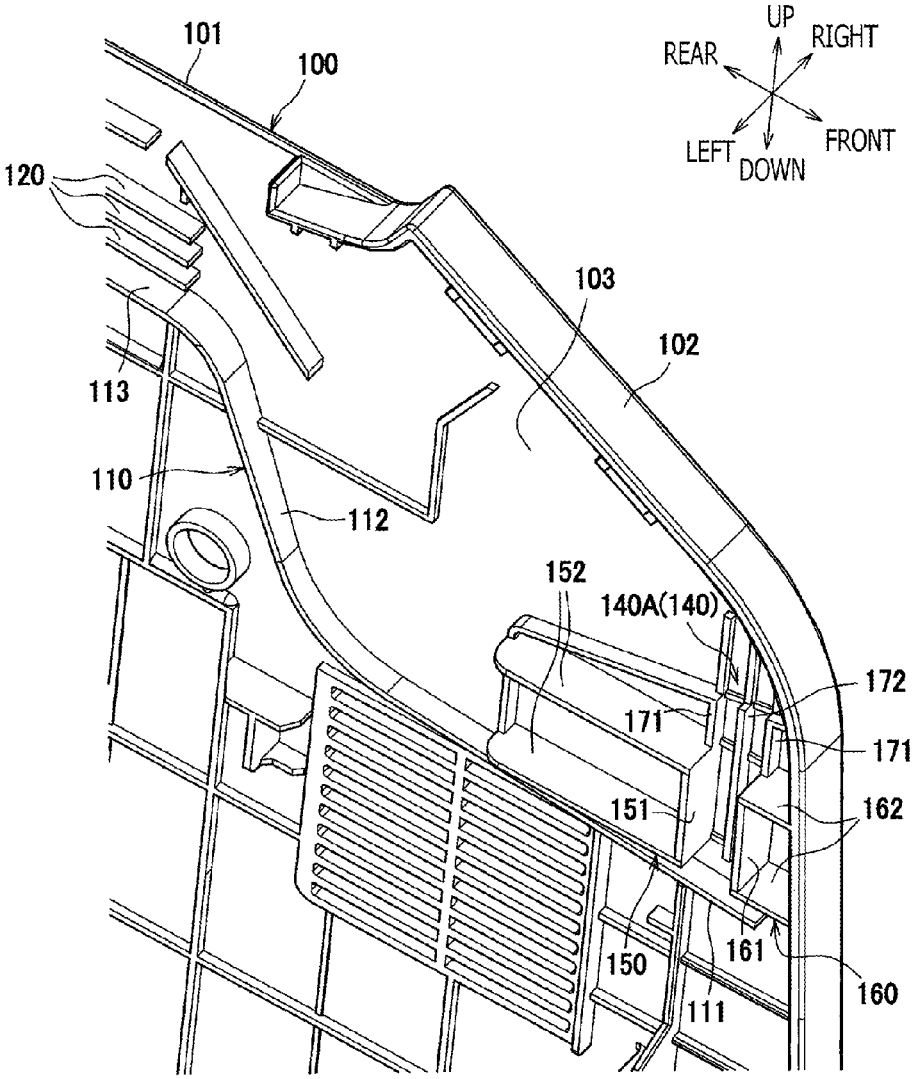
FIG. 7 is a perspective partial view of the side cover showing a front-end portion of the first rib and an on-cover channel in the MFD according to the embodiment of the present invention.

As shown in FIG. 7, the on-cover channel 140A is formed to extend along the vertical direction in an upper position with respect to the first part 111 of the first rib 110.

More specifically, the side cover 100 is formed to have a first protrusive fence 150, a second protrusive fence 160, a pair of first guide ribs 171, and a second guide rib 172. The first protrusive fence 150 is formed to have a shape of an overturned "U" in a lateral view, and the second protrusive fence 160 is formed in a frontward position with respect to the first protrusive fence 150 and has a shape of an overturned "U" in a lateral view.

The first protrusive fence 150 includes a first guide portion 151, which extends vertically in an upper position with respect to the first part 111 of the first rib 110, and first extending portions 152, which extend rearward from an upper end and a lower end of the first guide portion 151 respectively.

The second protrusive fence 160 includes a second guide portion 161, which extends vertically to face the first guide portion 151 of the first protrusive fence 150 in an upper position with respect to the first part 111 of the first rib 110, and a second extending portions 161, which extend frontward from an upper end and a lower end of the second guide portion 161 respectively.

One of the paired first ribs 171 extends upward from the upper end of the first guide portion 151, and the other of the paired first ribs 171 extends upward from the upper end of the second guide portion 161. The second guide rib 172 extends vertically through an area between the paired first guide ribs 171 and an area between the first guide portion 151 and the second guide portion 161.

In this regard, the area between the paired first guide ribs 171 and the area between the first guide portion 151 and the second guide portion 161 form the on-cover channel 140A, and a lower end of the first guide portion 151 and a lower end of the second guide portion 161 form an outlet of the on-cover channel 140A or the outlet 140. In a lower position with respect to the outlet of the on-cover channel 140A, the first part 111 of the first rib 110 is arranged.

Figure 8:
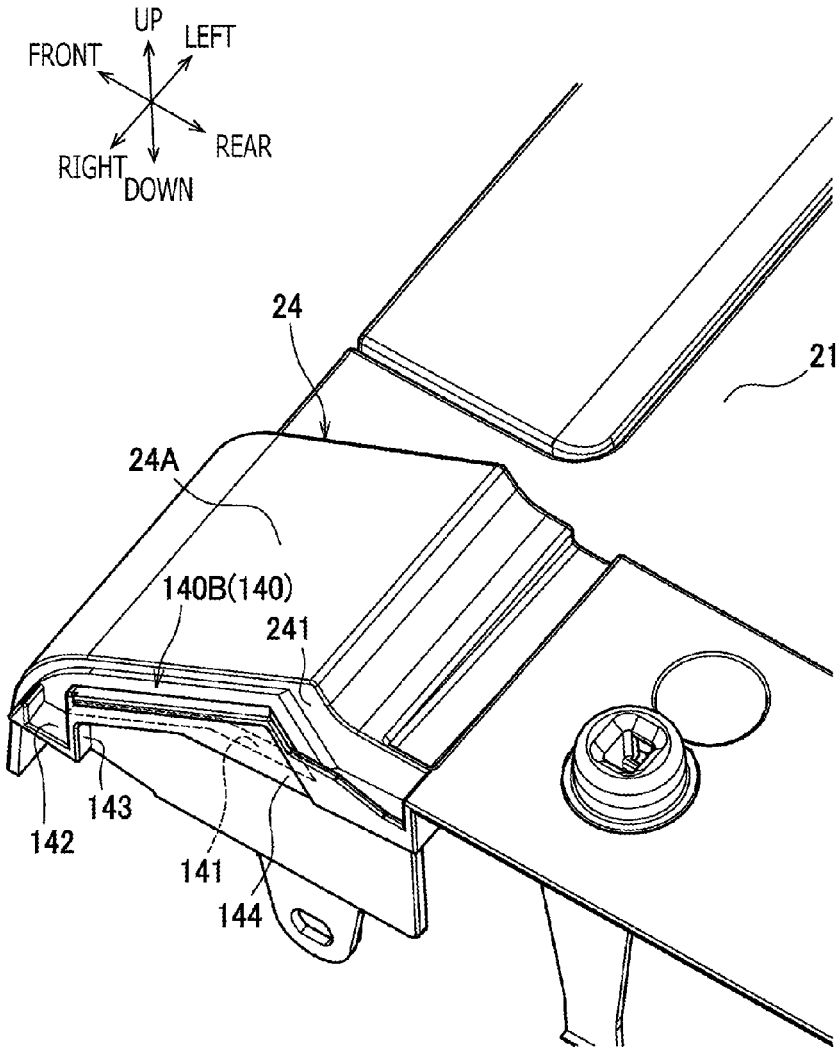
FIG. 8 is a perspective view of the side cover showing an on-body channel in the MFD according to the embodiment of the present invention.

Meanwhile, as shown in FIG. 8, the on-body channel 140B being another part the channel 140 is formed on the vertical block 24 of the main body 2. The on-body channel 140B extends along a lateral surface 241, which is on an outer side of the vertical block 24 along the widthwise direction, between a rear part of the vertical block 24, where the front end of the operation panel unit 4 overlaps the vertical block 24, and the front end of the vertical block 24.

In particular, the vertical block 24 includes a first bottom part 141, a second bottom part 142, a connecting wall 143, and a lateral part 144. The first bottom part 141 protrudes outward from the lateral surface 241 along the widthwise direction. The second bottom part 142 protrudes outward from the lateral surface 241 at a lower-frontward position with respect to the first bottom part 141. The connecting wall 143 connects a front end of the first bottom part 141 and a rear end of the second bottom part 142. The lateral part 144 extends upward from an outer end of the first bottom part 141 with regard to the widthwise direction. Among these parts on the vertical block 24, the first bottom part 141 and the second bottom part 142 form the on-body channel 140B. In the main body 2, the on-body channel 140B is covered by the front part 102 of the side cover 100 (see FIG. 7).

Thus, while an outer end of the second bottom part 142 with regard to the widthwise direction is arranged in the vicinity of the upper end of the second guide rib 172 of the on-cover channel 140A, the on-body channel 140B formed as above is connected with the on-cover channel 140A. Thereby, the liquid falling from the second bottom part 142 of the on-body channel 140B is guided to flow down along the second guide rib 172.

Below are described features and effects which may be caused by the MFD 1 configured as above.

As shown in FIG. 1, according to the MFD 1 in the present embodiment, liquid may flow inside the MFD 1 through the boundary B1 between the side cover 100 and the first lateral face 31 of the image reader 3, or through the boundary B2 between side cover 100 and the second lateral face 42 of the operation panel unit 4, which form parts the exterior covering of the MFD 1. Further, liquid may also enter inside the MFD 1 through the boundary B4 between the operation panel unit 4 and the vertical block 24.

The liquid flowing inside the MFD 1 through the boundary B1 or B2 may fall on the third part 113 of the first rib 110 or on the second ribs 120 (see FIG. 5). In this regard, with the third part 113 of the first rib 110, which protrudes at the lower position with respect to the second ribs 120 for the larger amount than the second ribs 120, the liquid that is not caught on the second ribs 120 may be caught on the third part 113.

Moreover, if a size of a droplet of the liquid entering inside the side cover 100 is rather large, the droplet may first hit on the plurality of second ribs 120 before falling on the third part 113 of the first rib 110 to be broken into smaller droplets. In this regard, the plurality of second ribs 120 adjoining along the vertical direction protrude for the same protruding amount; therefore, the liquid may fall straight down along edges of the second ribs 120 without being deflected widthwise inwardly than the third part 113.

While the MFD 1 may allow the liquid to enter through the boundary B3 between the first lateral face 31 of the image reader 3 and the second lateral face 42 of the operation panel unit 4, with the third part 113 of the first rib 110 being arranged below the boundary B3, the liquid entering inside the side cover 100 through the boundary B3 may be securely caught by the first rib 110.

Further, as shown in FIG. 6, the first rib 110 is provided with the first upright curb 110A and the second upright curb 110B at the rear end of the third part 113; therefore, the liquid may be restrained from falling down rearward through the rear end of the third part 113.

The liquid being caught on the third part 113 of the first rib 110 and the second ribs 120 may flow frontward along the upper surfaces of the third part 113 of the first rib 110 and the second ribs 120 (see FIG. 5).

In this regard, the second ribs 120 and the hooks 130 in the frontward positions with respect to the second ribs 120 are separated from each other; therefore, the liquid flowing on the second ribs 120 may be restrained from flowing inwardly through the hooks 130.

The liquid flowing on the third part 113 and the second ribs 120 may flow on the first part 111 of the first rib 110 and may finally fall down from the front end 110F of the first part 111.

Meanwhile, the liquid entering through the boundary B4 between the operation panel unit 4 and the vertical block 24 may fall on the channel 140 to flow down there-through. In this regard, with the first part 111 of the first rib 110 being arranged below the outlet of the channel 140, the liquid from the channel 140 may fall on the first part 111 to flow downward from the front end 110F of the first part 111.

Thus, the liquid flowing down through the channel 140 may also be drained to a same area as the liquid flowing down on the first rib 110.

Further, with the first rib 111 arranged in the position below the outer end of the boundary B4 between the operation panel unit 4 and the vertical block 24 on the side cover 100, even when the liquid entering through the boundary B4 between the operation panel unit 4 and the vertical block 24 did not fall on the channel 140, the liquid may be caught on the first rib 110.

Thus, with the above configuration, in which the liquid entering inside the side cover 100 may be drained to the predetermined areas, the components such as the motor and the circuit board, which may be sensitive to the liquid, may be restrained from being wet by the liquid.

Furthermore, with the rib 110 having the first part 111, the second part 112, and the third part 113, the third part 113 may be arranged at the upper end of the side cover 110 while the first part 111 may be arranged in the position below the outlet of the on-cover channel 140A.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Below are described some of the exemplary variations. In the following examples, items or structures which are the same as or similar to the items or the structures described in the previous embodiment will be referred to by the same reference signs, and description of those will be omitted.

Figure 9:
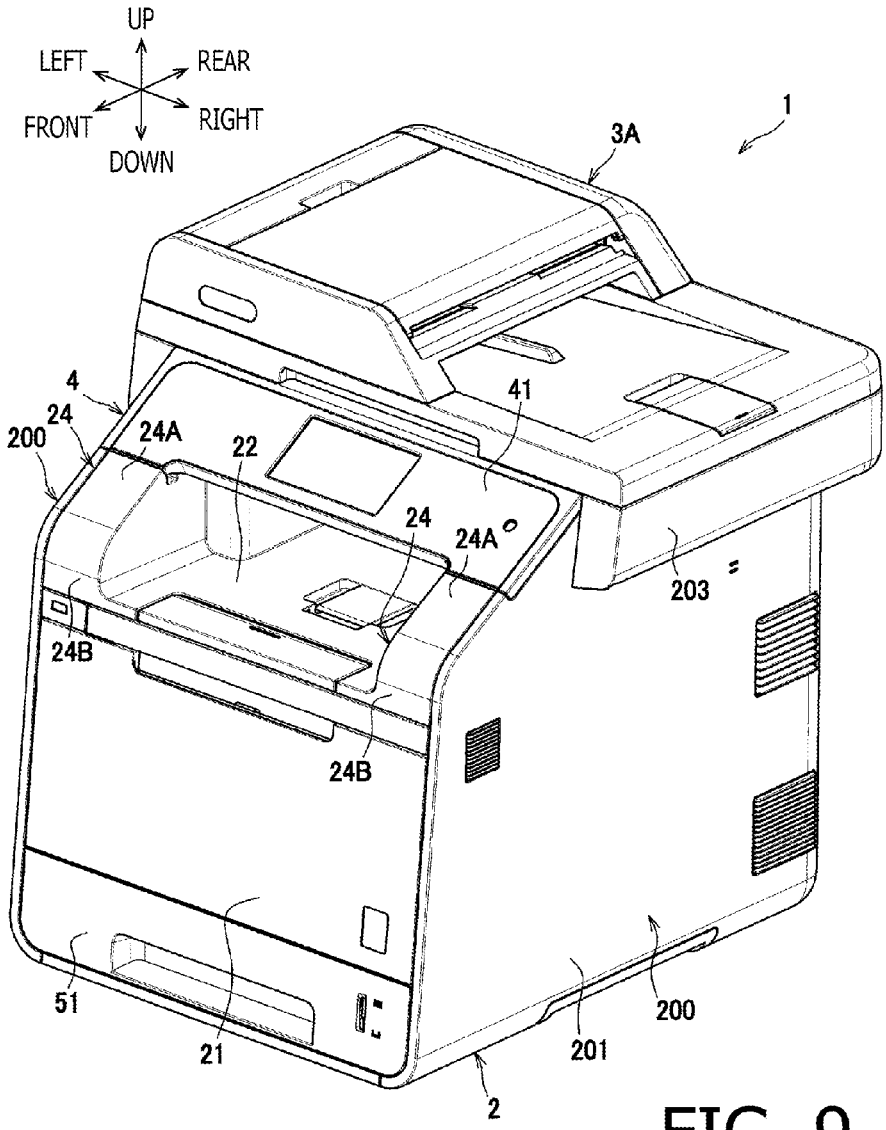
FIG. 9 is a perspective external view of a modified example of the MFD according to the embodiment of the present invention.

For example, the first lateral face 31 of the image reader 3 and the second lateral face 42 of the operation panel unit 4 may not necessarily adjoin each other on the side cover 100. As shown in FIG. 9, an image reader 3A may jut outward with respect to the operation panel unit 4 along the widthwise direction so that lateral faces of the image reader 3A may be displaced from the lateral faces of the operation panel unit 4 with regard to the widthwise direction.

In this configuration, pendent portions 203 on side covers 200 of the main body 2 may form exterior coverings of the jutting portions. Meanwhile, the lateral faces of the operation panel unit 4 may be covered by upper parts of the side covers 200.

Figure 10:
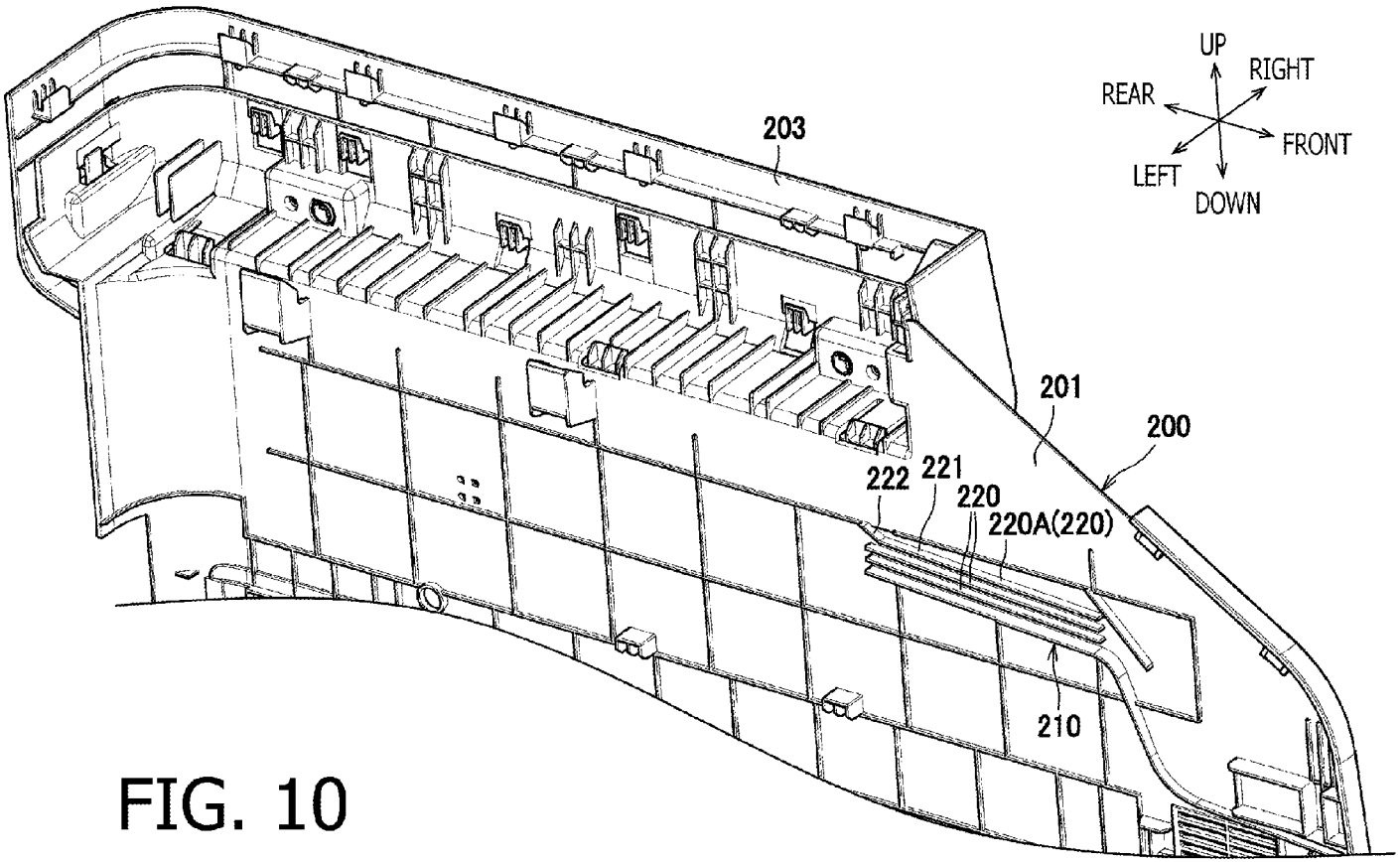
FIG. 10 is a perspective view showing an upper edge on an inner side of the side cover in the MFD of the modified example according to the embodiment of the present invention.

As shown in FIG. 10, the pendent portion 203 may jut outward with respect to a main body 201 along the widthwise direction at the upper part of the side cover 200. When liquid enters the pendent portion 203, the side cover 200 may catch the liquid at a bottom of the pendent portion 203; therefore, the liquid may be restrained from entering inside the main body 201.

Accordingly, the side cover 200 may not necessarily have the first rib 110 and the plurality of second ribs 120 throughout the depth along the front-rear direction but may have a first rib 210 and a plurality of second ribs 220 only at a front end.

In particular, the first rib 210 extends frontward from a rearward position with respect to a front end of the pendent portion 203. The second ribs 220 extend frontward from rearward positions with respect to the front end of the pendent portion 203.

A topmost second rib 220A among the plurality of second ribs 220 inclines as a whole to be higher at the rear and lower at the front while a rear end portion thereof is bent upward more acutely. In other words, the topmost second rib 220A includes a moderate part 221, which inclines at a relatively moderate angle, and an acute part 222, which extends from a rear end of the moderate part 221 to incline at a more acute angle than the moderate part 221. With the angle difference between the moderate part 221 and the acute part 222, the liquid falling on the rear end of the topmost second rib 220A may be restrained from falling rearward from the topmost second rib 220A.

Figure 11:
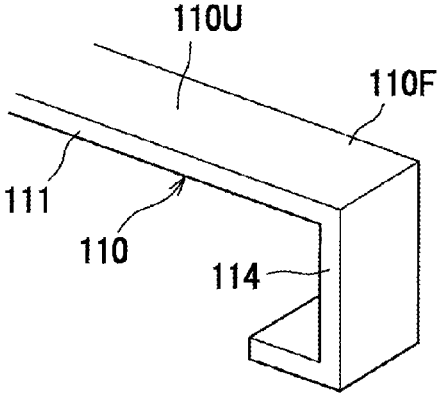
FIG. 11 is a side view showing the upper edge on the inner side of the side cover in the MFD of the modified example according to the embodiment of the present invention.

For another example, the first rib 110 may not necessarily be cut off at the front end 110F but may be formed to have a fourth part 114, which extends downward from the first part 111 at the front end 110F, as shown in FIG. 11. In this form, the upper surface 110U of the first rib 110 is discontinued at the front end 110F, but the liquid flowing on the first rib 110 may fall down from the edge of the upper plane 110U. The fourth part 114 may be formed to extend rearward from a lower end thereof.

For another example, the first rib 110 and the second ribs 120 may not necessarily extend in parallel with one another but may incline in different angles.

For another example, the first part 111 and the third part 113 in the first rib 110 may not necessarily incline at the same angle but may incline in different angles.

What is claimed is:

1. An image forming apparatus, comprising:

an image forming unit;

a body accommodating the image forming unit; and a cover configured to form a part of an exterior covering of the body, wherein the cover comprises a first rib formed to protrude from an inner surface of the cover and extend longitudinally along the inner surface of the cover;

wherein the first rib extends to incline with respect to a horizontal plane to be higher at one end on a first side of the image forming apparatus and lower at the other end on a second side of the image forming apparatus; and wherein an upper surface of the first rib extends continuously from the one end to the other end and is discontinued at the other end, the other end of the upper surface of the first rib being separated from the exterior covering.

2. The image forming apparatus according to claim 1, wherein the cover further comprises a second rib, the second rib being formed in an upper position with respect to the first rib to align with the first rib and protrude from the inner surface of the cover.

3. The image forming apparatus according to claim 2, wherein a protrusive amount for the first rib to protrude from the inner surface of the cover is larger than a protrusive amount for the second rib to protrude from the inner surface of the cover.

4. The image forming apparatus according to claim 3, wherein the second rib comprises a plurality of second ribs aligning with one another along a vertical direction;

wherein the plurality of second ribs protrude from the inner surface of the cover for the same protrusive amount.

5. The image forming apparatus according to claim 2, wherein the second rib extends to incline with respect to the horizontal plane to be higher at one end on the first side and lower at the other end on the second side;

wherein the cover comprises a projection arranged in a position closer to the second side with respect to the second rib, the projection projecting for a larger amount than the protrusive amount of the second rib; and wherein the second rib is separated from the projection.

6. The image forming apparatus according to claim 2, wherein the second rib comprises a moderate part, the moderate part inclining with respect to the horizontal plane to be higher at one end on the first side and lower at the other end on the second side, and an acute part, the acute part extending from the one end of the moderate part on the first side at a more acute angle than inclination of the moderate part.

7. The image forming apparatus according to claim 1, wherein the one end of the first rib is arranged at an end portion on the first side of the cover.

8. The image forming apparatus according to claim 7, wherein the one end of the first rib comprises an upward curb, the upward curb rising upward from the upper surface of the first rib to face with the inner surface of the cover at a part; and wherein the upward curb is connected with the inner surface of the cover at another part.

9. The image forming apparatus according to claim 1, further comprising:

an image reader arranged in an upper position with respect to the body; and an operation panel unit arranged in an upper position with respect to the body in a position to adjoin the image reader, wherein the image reader comprises a first face forming a part of an exterior covering of the image reader, and the operation panel unit comprises a second face forming a part of an exterior covering of the operation panel unit, the first face and the second face adjoining each other in the upper positions with respect to the body;

wherein the first rib is arranged in a position below a boundary between the first face and the second face.

10. The image forming apparatus according to claim 1, further comprising:

a wall block arranged to adjoin an upper part of the cover, the wall block comprising a plane facing upward; and an operation panel unit arranged to adjoin an upper part of the cover and to adjoin one end of the wall block closer to the first side, the operation panel unit comprising an upward plane, wherein the first rib is arranged in a position below a boundary between the wall block and the operation panel unit.

11. The image forming apparatus according to claim 10, wherein the first rib comprises a first part, a second part, the second part extending from one end of the first part on the first side at a more acute angle than inclination of the first part, and a third part, the third part extending from one end of the second part on the first side at a more moderate angle than inclination of the second part.

12. The image forming apparatus according to claim 11, further comprising:

a channel configured to drain liquid entering through a periphery of the operation panel unit, wherein the first part of the first rib is arranged in a position below an outlet of the channel.

* * * * *